US007606515B2

(12) United States Patent
Parisi et al.

(10) Patent No.: US 7,606,515 B2
(45) Date of Patent: Oct. 20, 2009

(54) COUPLING MECHANISM FOR MATERIAL SUPPLY MODULE

(75) Inventors: Michael A. Parisi, Fairport, NY (US); Richard W. Seyfried, Williamson, NY (US); John G. Shaw, Victor, NY (US)

(73) Assignee: Xerox Corporation, Norwalk, CT (US)

( * ) Notice: Subject to any disclaimer, the term of this patent is extended or adjusted under 35 U.S.C. 154(b) by 174 days.

(21) Appl. No.: 11/904,110

(22) Filed: Sep. 26, 2007

(65) Prior Publication Data

US 2009/0080936 A1 Mar. 26, 2009

(51) Int. Cl.
*G03G 15/00* (2006.01)

(52) U.S. Cl. ..... 399/167; 399/88

(58) Field of Classification Search ..... 399/167, 399/159, 117, 88
See application file for complete search history.

(56) References Cited

U.S. PATENT DOCUMENTS 5,788,151 A * 8/1998 Moroi et al. ..... 237/12.3 R
6,006,058 A * 12/1999 Watanabe et al. ..... 399/167
2005/0191092 A1* 9/2005 Toso et al. ..... 399/167
2008/0185925 A1* 8/2008 Kurple ..... 310/54

* cited by examiner

*Primary Examiner*—Sophia S Chen
(74) *Attorney, Agent, or Firm*—Pillsbury Winthrop Shaw Pittman LLP

(57) ABSTRACT

A coupling mechanism includes a driven coupling for mating with a driving coupling. The driven coupling includes a cylinder flange, a concentric shaft that extends axially outwardly from the flange, and a cylindrical driven coupling member that extends axially outwardly from the concentric shaft. The driven coupling member includes a flexible membrane that encases non-rigid fill material, such as, e.g., a flowable granular material or a non-Newtonian fluid. The driven coupling member has a non-twisted, triangular cross-section, and is configured such that, when it is operationally engaged with the driving coupling, the non-rigid material substantially solidifies, thereby providing a substantially non-flexible structure for the membrane. The driven coupling may be connected to, for example, a photoreceptor drum of a material supply module, and the driving coupling may be connected to a reprographic device.

15 Claims, 5 Drawing Sheets

COUPLING MECHANISM FOR MATERIAL SUPPLY MODULE

BACKGROUND

Many reprographic and/or electrostatographic image-forming devices, such as copiers, facsimile apparatus, printers, and the like include a replaceable or refillable material supply module. The material supply module is typically connected to such a device via a drive shaft and gear shaft coupling arrangement, which generally includes a drive shaft integral to the module that interacts with a gear shaft integral to the particular device.

FIG. 1 shows a drive shaft and gear shaft coupling arrangement 20, which is currently used in the material supply module of copiers, facsimile apparatus, printers, and similar electrostatographic image forming devices. A drive gear 22 drives a driveshaft cylinder 24 of a drive shaft 25. Drive gear 22 includes a gear shaft 26 at its center and a geared outside edge 28. Gear shaft 26 has a front surface 30, which includes a twisted triangular coupling hole 32 having defined vertices 33 formed therein. Driveshaft cylinder 24 is fixedly mounted with a cylinder flange 34, which includes an axially outwardly extending concentric shaft 36 and a geared outside edge 38. Concentric shaft 36 includes an axially outwardly twisted, triangular coupling member 40, which is axially raised from an outer, or front, surface 42 of the shaft 36 for coupling to the twisted triangular coupling hole 32 on gear shaft 26 of drive gear 22.

During the life of a device, driveshaft cylinder 24 and drive shaft 25 may be replaced one or more times depending on the frequency of use. Typically, the cylinder flange 34 is replaced when the driveshaft cylinder 24 and the drive shaft 25 are replaced. Because twisted triangular coupling member 40 of cylinder flange 34 generally twists in one direction and its torque forces are adjacent its axis of rotation, its fabrication is both complicated and expensive. In addition, because the torque forces acting on twisted triangular coupling member 40 of cylinder flange 34 are adjacent its axis of rotation, the member encounters high stresses.

FIGS. 2 and 3 show another coupling arrangement, or mechanism, including a driven coupling 50 and a driving coupling 60. The driven coupling 50 includes a cylinder flange 51 with a geared outside edge 52 and an axially outwardly extending concentric shaft 54. A twisted triangular-shaped coupling member 55 extends axially outwardly from an outer surface 53 of the shaft 54. Coupling member 55 has defined therein a central bore 57 that is configured to receive a locator or alignment pin 64 of the driving coupling 60.

With reference to FIG. 3, driving coupling 60 may be positioned in a conventional reprographic device and includes a stationary outer bushing 61 encasing a rotatable and retractable machine drive 62. Machine drive 62 has a socket 67 therein that is complementary to the shape of coupling member 55. The locator or alignment pin 64 is generally conical in shape and is centered within the machine drive 62 so as to mate with the central bore 57 in the coupling member 55. Locator pin 64, which is generally truncated, has freedom to move in the axial direction and is intended to ensure centering of the driven coupling 50. Engagement of the driven and driving couplings constituting the coupling mechanism initially requires a minimal axial engagement, as the two couplings are forced together into complete engagement by virtue of the torque. However, here, too, because the torque forces acting on triangular coupling member 55 are adjacent its axis of rotation, the member encounters high stresses.

BRIEF SUMMARY

According to one aspect, there is provided a coupling mechanism for detachably connecting a material supply module with a reprographic device. A driving coupling is attached to the reprographic device, and a driven coupling is joined with the material supply module. The driven coupling includes a cylinder flange having a concentric shaft extending axially outwardly therefrom. A cylindrical coupling member extends axially outwardly from the concentric shaft of the driven coupling. The cylindrical coupling member comprises a flexible membrane that encases non-rigid fill material and has a non-twisted, triangular cross-section. When the driving and driven couplings are operationally engaged, the non-rigid material substantially solidifies, thereby imparting a rigid, substantially non-flexible structure to the membrane. The driving coupling may include an axial socket, and an alignment pin that extends axially outwardly therefrom. The cylindrical coupling member is configured to fit within the driving coupling's socket and includes a central hole for receiving the alignment pin.

According to another aspect, there is provided a photoreceptor drum for use in producing an image in conjunction with a reprographic device. At one of its ends, the photoreceptor drum is joined with a cylinder flange having a concentric shaft that extends axially outwardly therefrom. A cylindrical coupling member extends axially outwardly from the concentric shaft and is configured to mate with a driving coupling that may be attached to the reprographic device. The cylindrical coupling member comprises a flexible membrane that encases non-rigid fill material and has a non-twisted, triangular cross-section. During operational use, the non-rigid material substantially solidifies, thereby imparting a substantially non-flexible structure to the membrane.

According to yet another aspect, there is provided a material supply module for detachable connection to a reprographic device. The material supply module comprises a housing and a photoreceptor drum joined with the housing. The drum is joined, at one of its ends, with a cylinder flange that has a concentric shaft extending axially outwardly therefrom. A cylindrical coupling member extends axially outwardly from the concentric shaft and is configured to mate with a driving coupling that may be attached to the reprographic device. The cylindrical coupling member comprises a flexible membrane that encases non-rigid fill material and has a non-twisted, triangular cross-section. During operational use, the non-rigid material substantially solidifies, thereby imparting a rigid, substantially non-flexible structure to the membrane.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION

Figure 4:
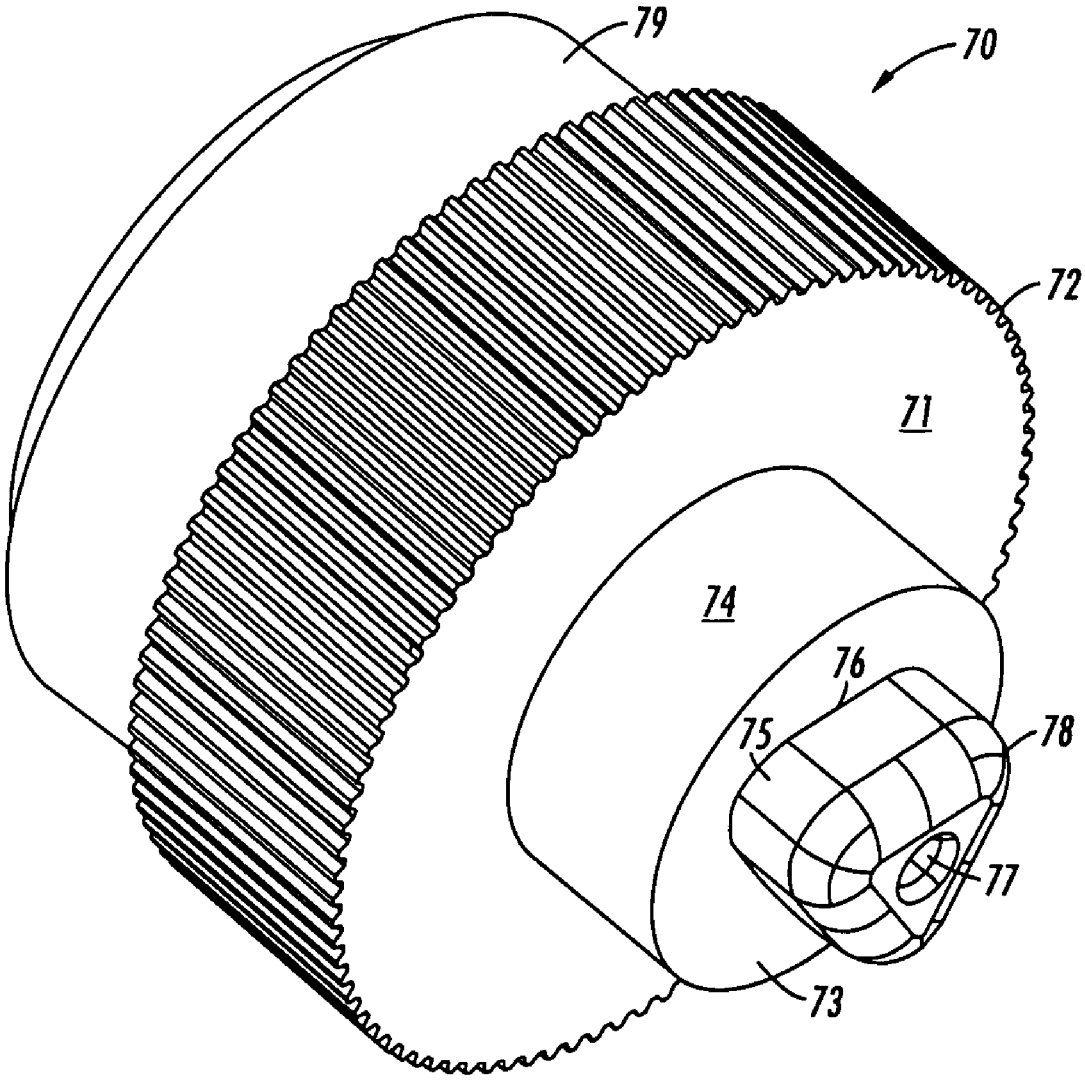
FIG. 4 shows a driven coupling of a coupling mechanism according to an embodiment of the present invention.

In accordance with an embodiment of the present invention, FIG. 4 shows a driven coupling 70 which may be attached to a photoreceptor drum at the photoreceptor attachment end 79 thereof. The driven coupling 70 includes a geared outside edge 72 and a cylinder flange 71 that has a concentric shaft 74 extending axially outwardly therefrom. Concentric shaft 74, in turn, has an outer surface 73, to which a driven coupling member 75 is centrally attached.

Figure 5:
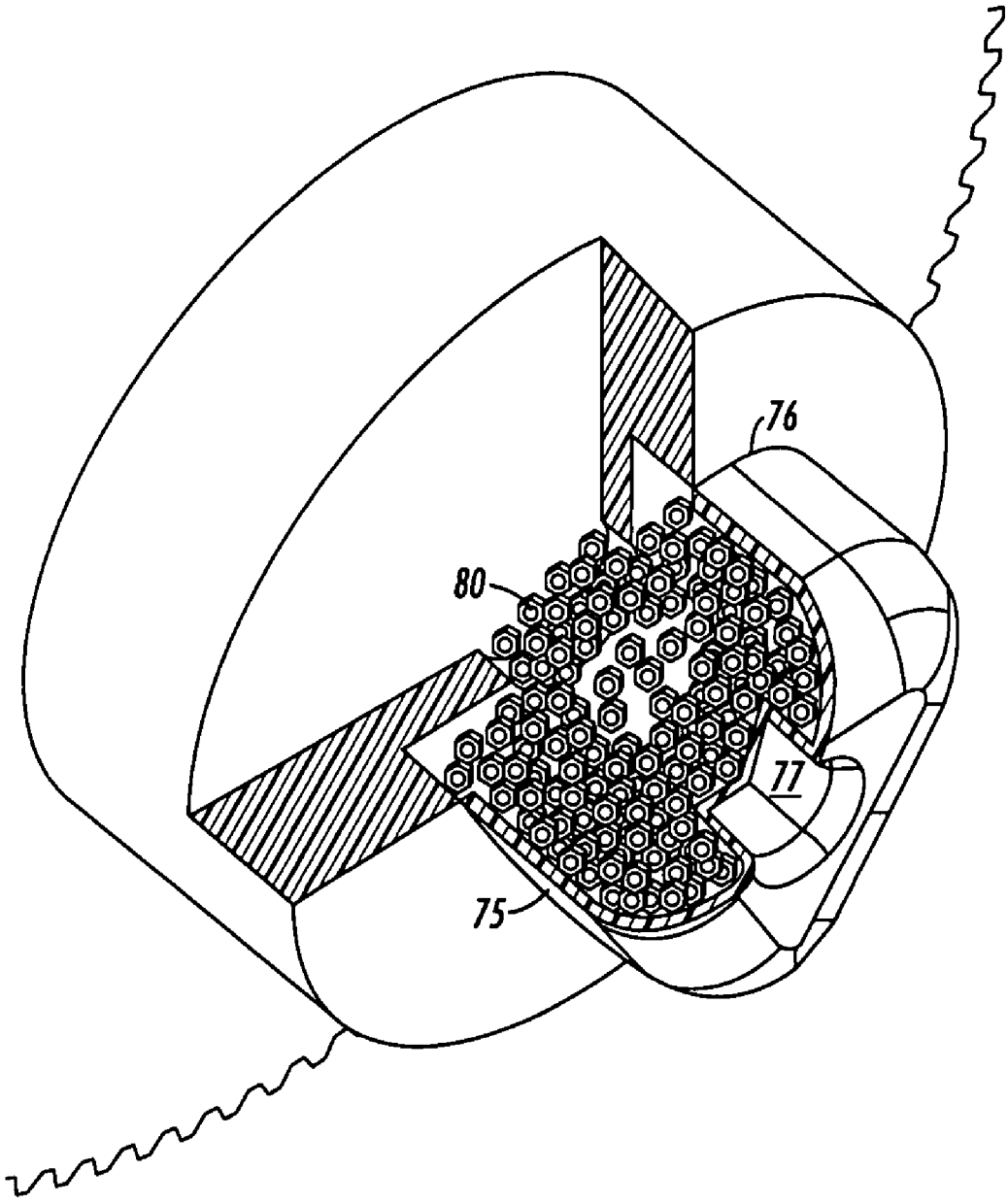
FIG. 5 is cut-away view of the driven coupling of FIG. 4.

The driven coupling member 75 has a first, or bottom, end 76 that is attached to the outer surface 73 of the concentric shaft 74. Opposite first end 76, the driven coupling member 75 has a second, or top, end 78. As shown in FIGS. 4 and 5, in one embodiment of the present invention, the driven coupling member 75 may be tapered, or beveled, at its top end 78. In alternative embodiments, the driven coupling member 75 may be tapered along a larger portion of its length (i.e., along the distance between its respective ends 76, 78), or along substantially the entirety of its length. In the latter case, the cross-sectional area of the driven coupling member 75 decreases continuously in an axial (i.e., longitudinal) direction between the first end 76 and the second end 78.

In a preferred embodiment, the driven coupling member 75 comprises a durable, but flexible, membrane that is shaped into a cylindrical "sack" having a non-twisted, triangular cross-section. As shown in FIGS. 4 and 5, the bottom end 76 of the sack is attached to the outer surface 73 of the concentric shaft 74. The sack is filled with non-rigid fill material, such as, e.g., a flowable granular material, or a non-Newtonian fluid, 80. As is known, such materials have variable viscosities. As such, when no sheer (stress) forces are applied, the material flows freely, i.e., behaves like a liquid, and has a lower viscosity. However, when sheer (stress) forces are applied, the material packs itself into a rigid state, i.e., solidifies, and has a higher viscosity.

Figure 1:
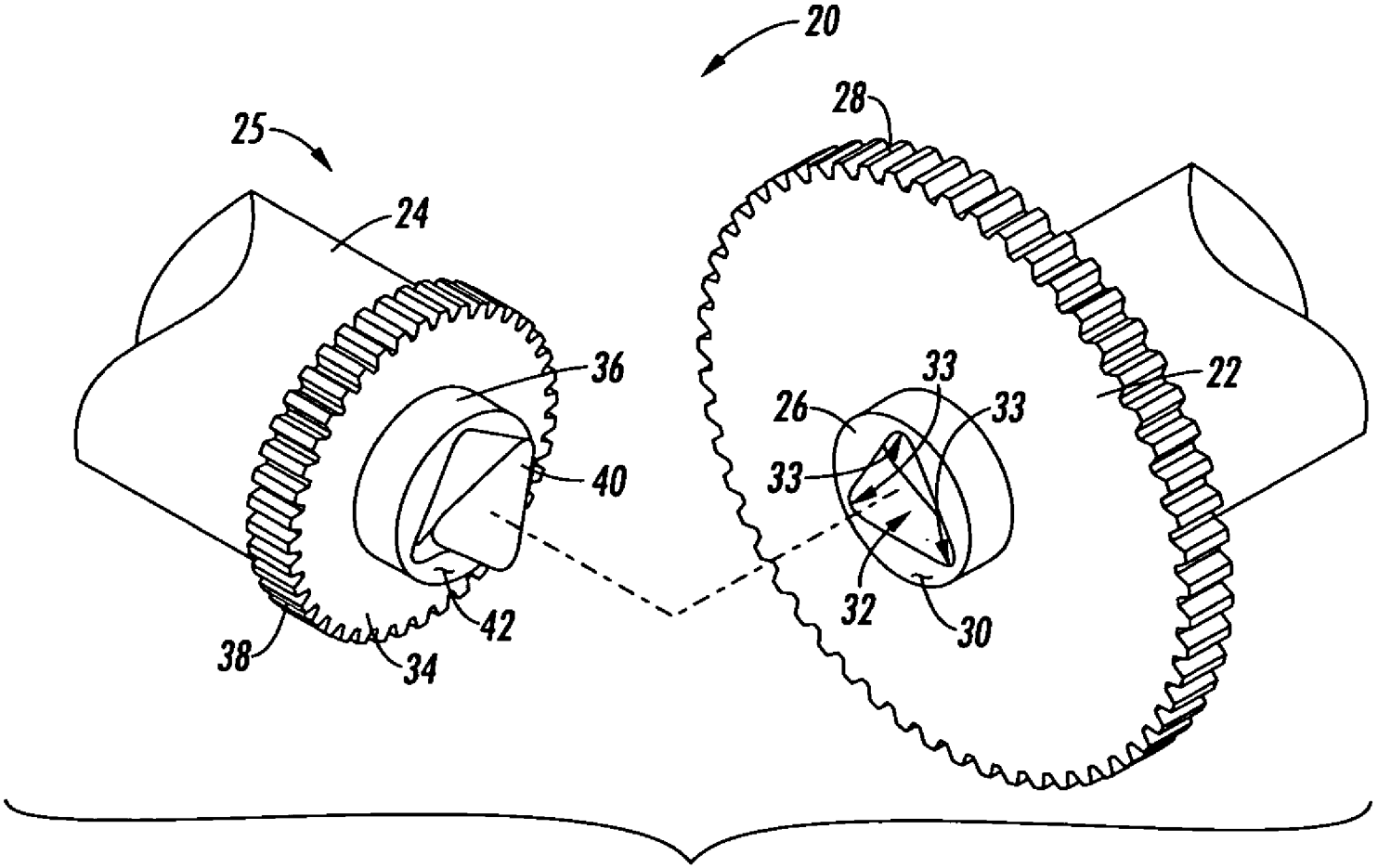
FIG. 1 (PRIOR ART)
FIG. 1 is a prior-art coupling arrangement.
Figure 2:
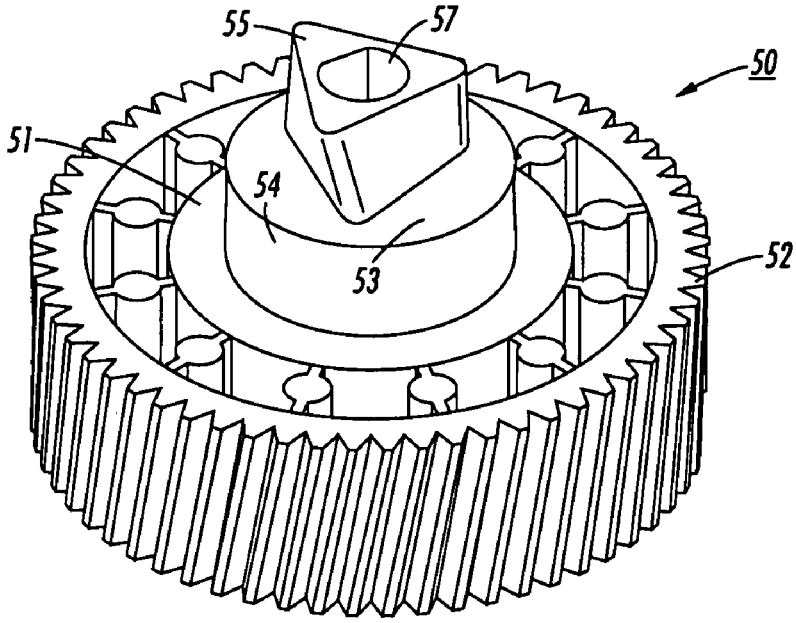
FIG. 2 (PRIOR ART)
FIG. 2 shows the driven coupling of a prior-art coupling arrangement.
Figure 3:
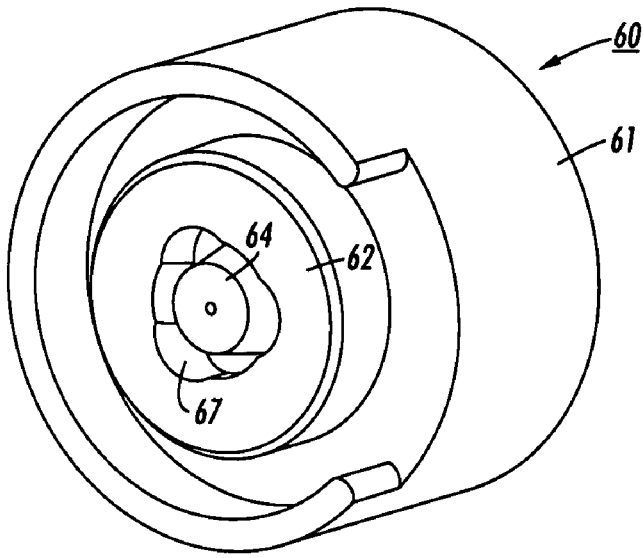
FIG. 3 (PRIOR ART)
FIG. 3 shows the driving coupling of a prior-art coupling arrangement.

In embodiments of the invention, the driven coupling member 75 of the driven coupling 70 is adapted to fit within the socket 67 of the driving coupling 60 shown in FIG. 3. In this regard, the membrane constituting the driven coupling member 75 is configured to include a central axial hole 77 that receives and mates with the pin 64. The specific shape of the hole 77 generally tracks that of the alignment pin 64. Thus, in one embodiment, where the pin 64 has a truncated, conical shape, the hole 77 also has a complementary conical configuration.

In practice, when the driven coupling 70 is not attached to, or engaged with, a driving coupling (such as, e.g., the driving coupling 60), the driven coupling member 75 has no stress applied to it. As such, the fill material inside the sack is in a non-rigid state, which allows the membrane to have sufficient flexibility such that the driven coupling member 75 may enter and fit within the socket 67 with relative ease. However, once the driving and driven couplings have been engaged, and the driving coupling is operated, the torque that is applied generates stress forces that cause the fill material to transform to a rigid state. This, in turn, causes the membrane to have a substantially non-flexible structure that is able to transmit the applied torque during operation. In general, in embodiments of the invention, the torque that is applied may generate stress forces that cause the fill material in combination with the sack material and the surface and material of the driving coupling's surface to transfer the applied torque from the driving coupling to the driven coupling.

In embodiments of the invention, the membrane of the driven coupling member may be made of plastic, rubber, or other durable, but flexible material. In yet other embodiments, rather than a membrane that encases fill material, the driven coupling member 75 may be made of a homogeneous or non-homogeneous substance that exhibits some of the same properties (e.g., conformability, durability, flexibility, etc.) of the driven coupling member 75 described above.

Figure 6:
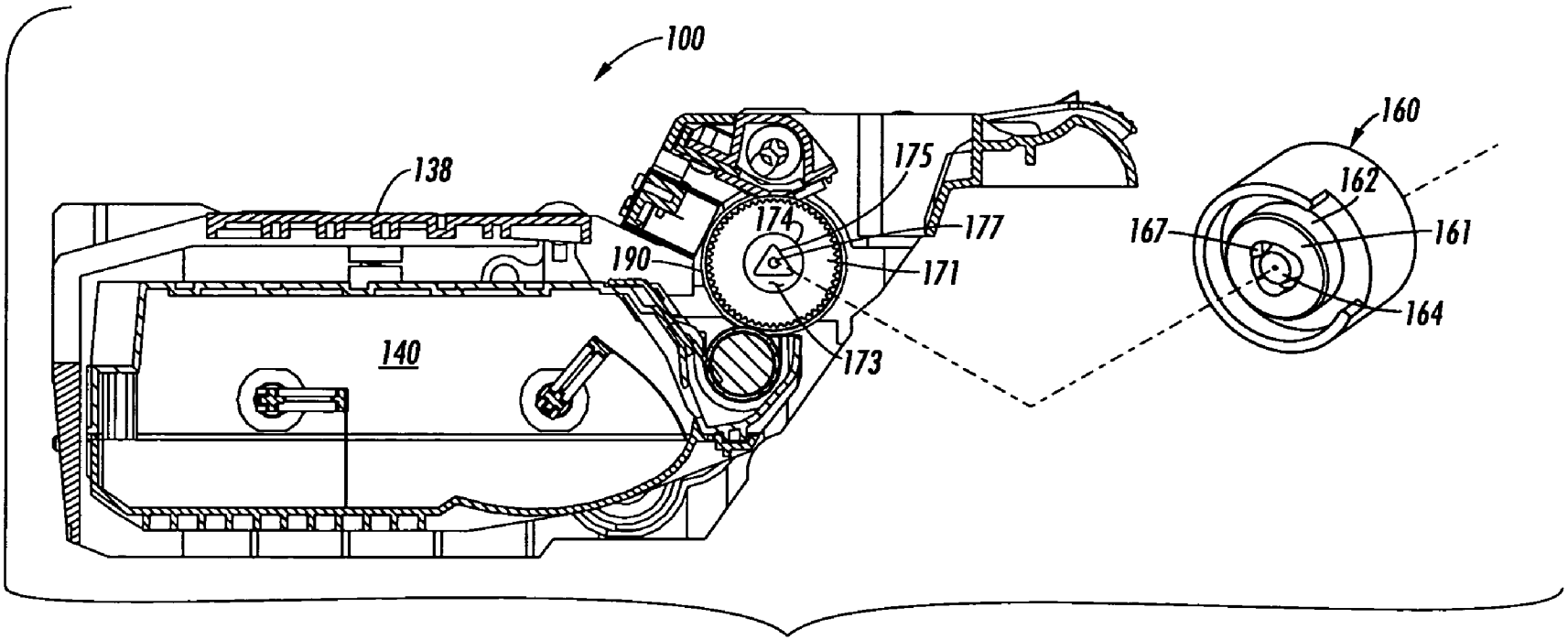
FIG. 6 is a material supply module according to an embodiment of the present invention.

Referring now to FIG. 6, an embodiment of the invention is directed to a module installable in a printing apparatus employing the driving coupling shown in FIG. 3. More specifically, material supply module 100 is configured to be detachably connected to the driving coupling 160 of a reprographic device. The driving coupling 160 includes a rotatable machine drive 162 which, in turn, has a central socket 167 adapted to receive the driven coupling member 175. In addition, a generally conical, axially-extending locator or alignment pin 164 is centered within the machine drive 162 so as to mate with an axial hole 177 in the driven coupling member 175.

Material supply module 100 includes a housing 138 and a photoreceptor drum 190 which may be removably joined with the housing 138. Housing 138 generally includes an integral reservoir 140 for containing materials. However, reservoir 140 may also be separate but connectable to the housing 138. At one end thereof, the photoreceptor drum 190 includes cylinder flange 171. A concentric shaft 174 extends axially outwardly from cylinder flange 171 and includes outer surface 173, which is configured to be substantially parallel to front surface 161 of machine drive 162. The driven coupling member 175 extends longitudinally outwardly from outer surface 173 of concentric shaft 174 and is configured to engage the socket 167.

It should be understood that any of the features, characteristics, alternatives, or modifications described regarding a particular embodiment herein may also be applied, used, or incorporated with any other embodiment described herein.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A photoreceptor drum for use in producing an image in conjunction with a reprographic device, the photoreceptor drum comprising:

a cylinder flange joined to one end of said photoreceptor drum, said flange having a concentric shaft extending axially outwardly therefrom; and a cylindrical coupling member extending axially outwardly from said concentric shaft and comprising a flexible membrane encasing non-rigid material therein, wherein, during use, said non-rigid material substantially solidifies, and said membrane has a substantially non-flexible structure, wherein the photoreceptor drum is configured to be detachably connected to a driving coupling attached to the reprographic device, the driving coupling defines a triangular socket through a center thereof, and the cylindrical coupling member is configured to fit within said triangular socket, and further wherein said socket includes a truncated, axially outwardly extending conical pin through the center thereof, and said membrane of the cylindrical coupling member defines an axial hole through the center thereof for receiving said conical pin.

2. The photoreceptor drum of claim 1, wherein said cylindrical coupling member has a non-twisted, triangular cross-section.

3. The photoreceptor drum of claim 1, wherein said cylindrical coupling member has a first end that is connected to the concentric shaft and an opposing second end that is tapered.

4. The photoreceptor drum of claim 1, wherein said non-rigid material is selected from the group consisting of a non-Newtonian fluid and a flowable granular material.

5. The photoreceptor drum of claim 1, wherein said membrane is made of plastic.

6. A coupling mechanism for detachably connecting a material supply module with a reprographic device, comprising:

a driving coupling attached to said reprographic device; and a driven coupling joined with said material supply module, said driven coupling including a cylinder flange having a concentric shaft extending axially outwardly therefrom, and a cylindrical driven coupling member extending axially outwardly from said concentric shaft and configured to mate with said driving coupling, wherein the driven coupling member comprises a flexible membrane encasing non-rigid material therein, said membrane being configured to have a substantially non-flexible structure when operationally engaged with said driving coupling, wherein the driving coupling defines a triangular socket through a center thereof, said socket including a truncated, axially outwardly extending conical pin through the center thereof, and the membrane of the driven coupling member defines an axial hole through the center thereof for receiving said conical pin.

7. The coupling mechanism of claim 6, wherein said cylindrical driven coupling member has a non-twisted, triangular cross-section.

8. The coupling mechanism of claim 6, wherein said cylindrical driven coupling member has a first end that is connected to the concentric shaft and an opposing second end that is tapered.

9. The coupling mechanism of claim 6, wherein said non-rigid material is selected from the group consisting of a non-Newtonian fluid and a flowable granular material.

10. The coupling mechanism of claim 9, wherein, during operational engagement between the driven coupling member and the driving coupling, said non-rigid material substantially solidifies, thereby providing a substantially non-flexible structure for said membrane.

11. The coupling mechanism of claim 6, wherein said membrane is made of plastic.

12. A material supply module for detachable connection to a reprographic device, said module comprising:

a housing;

a photoreceptor drum joined with said housing, said photoreceptor drum including a cylinder flange joined to one end thereof, and said flange having a concentric shaft extending axially outwardly therefrom; and a cylindrical coupling member extending axially outwardly from the concentric shaft and comprising a flexible membrane that encases non-rigid material therein, wherein, during use, said non-rigid material substantially solidifies, and said membrane has a substantially non-flexible structure, wherein said photoreceptor drum is configured to be detachably connected to a driving coupling attached to the reprographic device, the driving coupling defines a triangular socket through a center thereof, and the cylindrical coupling member is configured to fit within said triangular socket, and further wherein said socket includes a truncated, axially outwardly extending conical pin through the center thereof, and said membrane of the cylindrical coupling member defines an axial hole through the center thereof for receiving said conical pin.

13. The material supply module of claim 12, wherein said cylindrical coupling member has a non-twisted, triangular cross-section.

14. The material supply module of claim 12, wherein said cylindrical coupling member has a first end that is connected to the concentric shaft and an opposing second end that is tapered.

15. The material supply module of claim 12, wherein said non-rigid material is selected from the group consisting of a non-Newtonian fluid and a flowable granular material.

* * * * *